US006172287B1

(12) United States Patent
Kang

(10) Patent No.: US 6,172,287 B1
(45) Date of Patent: Jan. 9, 2001

(54) GUITAR STRING TUNING DEVICE

(76) Inventor: Han Soo Kang, 264-14 Kaebong-Dong Kuro-Ku, Seoul (KR)

( * ) Notice: Under 35 U.S.C. 154(b), the term of this patent shall be extended for 0 days.

(21) Appl. No.: 09/474,028

(22) Filed: Dec. 28, 1999

(30) Foreign Application Priority Data

Nov. 18, 1999 (KR) ..... 99-2530

(51) Int. Cl.[7] ..... G10D 3/14
(52) U.S. Cl. ..... 84/304; 84/312 R; 84/305
(58) Field of Search ..... 84/312 R, 304, 84/305, 306

(56) References Cited

U.S. PATENT DOCUMENTS

| | | | | |
|---|---|---|---|---|
| 4,077,295 | * | 3/1978 | Zapp | 84/304 |
| 4,191,086 | * | 3/1980 | Spercel | 84/306 |
| 4,348,934 | * | 9/1982 | Ogata | 84/306 |
| 4,497,236 | * | 2/1985 | Rose | 84/298 |
| 4,970,930 | * | 11/1990 | Secord | 84/306 |
| 5,018,424 | * | 5/1991 | Steinberger | 84/304 |
| 5,097,736 | * | 3/1992 | Turner | 84/304 |
| 5,277,095 | * | 1/1994 | Steinberger | 84/304 |
| 5,381,715 | * | 1/1995 | Spercel | 84/304 |
| 5,705,760 | * | 1/1998 | Rose | 84/298 |
| 5,728,955 | * | 3/1998 | Sperzel | 84/306 |
| 5,767,427 | * | 6/1998 | Corso | 84/306 |
| 5,847,295 | * | 12/1998 | Klepacki | 84/305 |

* cited by examiner

*Primary Examiner*—David Martin
*Assistant Examiner*—Kim Lockett
(74) *Attorney, Agent, or Firm*—Jacobson, Price, Holman & Stern, PLLC

(57) ABSTRACT

Disclosed is a guitar string tuning device. The device comprises a tuning peg for winding therearound and unwinding therefrom a guitar string thereby to tune the guitar string, the tuning peg having a slit which is defined at an upper end thereof and a worm wheel which is formed at a lower end thereof; a housing for accommodating the tuning peg therein in a manner such that the tuning peg is maintained in an upright posture; a manipulating lever having a worm which is formed at one end thereof in a manner such that the worm enters into the housing to be meshed with the worm wheel of the tuning peg which is accommodated in the housing and a tuning handle which is formed at the other end thereof; and a clamping section for clamping the guitar string to the tuning peg which is rotated by manipulating the tuning handle, the clamping section including a clamping shaft which has a predetermined width extending in a lengthwise direction of the guitar string which is inserted through the slit of the tuning peg, the clamping section further including threadedly movable means for allowing the clamping shaft to be moved in a direction wherein the clamping shaft squeezes the guitar string against a bottom surface of the slit defined in the tuning peg.

2 Claims, 3 Drawing Sheets

GUITAR STRING TUNING DEVICE

BACKGROUND OF THE INVENTION

1. Field of the Invention

The present invention relates to a guitar string tuning device, and more particularly, the present invention relates to a guitar string tuning device which exerts uniform clamping force over a predetermined length of a guitar string in a direction perpendicular to a lengthwise direction of the guitar string when clamping the guitar string after inserting it through a slit defined in a tuning peg, thereby preventing the guitar string from easily snapping due to stress concentration.

2. Description of the Related Art

Generally, a guitar which is a kind of stringed musical instrument, has a set of strings, and, by playing the guitar, sounds are produced in association with musical notes of the guitar strings. Because the guitar sound best matches the human voice when compared to other musical instruments, it has been widely popularized throughout the world.

Conventionally, a guitar includes a body which serves as an echo plate, and a guitar neck and an instrument head which are sequentially formed in a direction where guitar strings extend from a bridge of the body.

The guitar neck has a finger board which is formed on an upper surface thereof or is integrally attached thereto. A plurality of frets are mounted to the finger board at places which correspond to respective musical scales. Guitar strings are placed under tension across the plurality of frets and along the guitar neck.

Accordingly, as the guitar strings are fingered at a location of a sound hole which is defined in a soundboard in a state wherein a performer presses guitar strings against the guitar neck at a proper position, vibrations of the guitar strings are transferred to the soundboard, by which air is vibrated to generate musical sound.

The guitar strings vary in their thicknesses and types. One end of each guitar string is fastened to the bridge of the body by a pin, and the other end of the guitar string is fastened to a guitar string tuning device at a place where a tuning peg is positioned.

FIG. 1*a* is a longitudinal cross-sectional view of a conventional guitar string tuning device, illustrating a state wherein a guitar string is inserted through a hole which is defined in a tuning peg; and FIG. 1*b* is a view similar to FIG. 1*a*, illustrating another state wherein the guitar string is clamped to the tuning peg.

As shown in FIG. 1*a*, the guitar string tuning device 10 of the conventional art includes a tuning peg 12 through which a guitar string 8 is inserted such that the guitar string 8 can be integrally rotated with the tuning peg 12, a housing 14 which accommodates the tuning peg 12, a manipulating lever 16 which is provided to rotate the tuning peg 12 accommodated in the housing 14, and clamping means 18 which clamps the guitar string 8 to the tuning peg 12.

The tuning peg 12 has a hole 21 which is defined adjacent to an upper end thereof. The hole 21 extends in a horizontal direction. A tunnel 23 is also defined in the tuning peg 12 in a manner such that it extends in a vertical direction while it is communicated with the hole 21 at an upper end thereof. An internally threaded portion 25 is formed inside a lower end of the tuning peg 12, and a worm wheel 27 is formed outside the lower end of the tuning peg 12.

The housing 14 has a neck portion which extends upward together with the tuning peg 12, and a threaded locking sleeve 29 is locked to an upper end of the housing 14. A lower end of the housing 14 is formed with a chamber in which the worm wheel 27 of the tuning peg 12 is accommodated.

The manipulating lever 16 has a worm which is formed at one end thereof in a manner such that it enters into the chamber of the housing 14 to be meshed with the worm wheel 27 of the tuning peg 12 and a tuning handle 12 which is formed at the other end thereof in a manner such that it can be manipulated to rotate the tuning peg 12.

The clamping means 18 includes a rod member 33 which is fitted into the tunnel 23 defined in the tuning peg 12 and an externally threaded shaft 35 which is threadedly coupled to the internally threaded portion of the tuning peg 12.

Accordingly, as shown in FIG. 1*b*, when a guitarist or a performer rotates a squeezing knob 37 which is integrally fastened to the externally threaded shaft 35, the externally threaded shaft 35 is threadedly moved upward in an axial direction. By this, as the rod member 33 is biased upward by the externally threaded shaft 35 into the tunnel 23 which is defined in the tuning peg 12, the rod member 33 clamps the guitar string 8 to a wall of the tuning peg 12 which wall defines the hole 21.

However, while the guitar string tuning device of the convention art constructed as mentioned above can clamp the guitar string 8 to the wall of the tuning peg 12 which wall defines the hole 21, the conventional guitar string tuning device suffers from defects in that, since the rod member 33 has a small diameter, stress concentration is generated in the guitar string 8, whereby the likelihood of the guitar string 8 to snap due to its tension is increased.

SUMMARY OF THE INVENTION

Accordingly, the present invention has been made in an effort to solve the problems occurring in the related art, and an object of the present invention is to provide a guitar string tuning device which exerts uniform clamping force over a predetermined length of a guitar string in a direction perpendicular to a lengthwise direction of the guitar string when clamping the guitar string after inserting it through a slit defined in a tuning peg, thereby preventing the guitar string from easily snapping due to stress concentration.

In order to achieve the above object, according to the present invention, there is provided a guitar string tuning device comprising: a tuning peg for winding therearound and unwinding therefrom a guitar string thereby to tune the guitar string, the tuning peg having a slit which is defined at an upper end thereof and a worm wheel which is formed at a lower end thereof; a housing for accommodating the tuning peg therein in a manner such that the tuning peg is maintained in an upright posture; a manipulating lever having a worm which is formed at one end thereof in a manner such that the worm enters into the housing to be meshed with the worm wheel of the tuning peg which is accommodated in the housing and a tuning handle which is formed at the other end thereof; and a clamping section for clamping the guitar string to the tuning peg which is rotated by manipulating the tuning handle, the clamping section including a clamping shaft which has a predetermined width extending in a lengthwise direction of the guitar string which is inserted through the slit of the tuning peg, the clamping section further including threadedly movable means for allowing the clamping shaft to be moved in a direction wherein the clamping shaft squeezes the guitar string against a bottom surface of the slit defined in the tuning peg.

By the feature of the present invention, when it is required to replace a guitar string with a new one, one end of the new guitar string is inserted through the slit which is defined at the upper end of the tuning peg, and the threadedly movable means of the clamping section is rotated to be threadedly moved downward. According to this, the clamping shaft is enabled to squeeze the guitar string with uniform clamping force against the bottom surface of the slit which is defined in the tuning peg, in a direction perpendicular to a lengthwise direction of the guitar string. In this situation, by manipulating the tuning handle of the manipulating lever, the tuning peg is rotated due to the fact that the worm wheel of the tuning peg is meshed with the worm of the manipulating lever, and thereupon, the guitar string is smoothly wound around the tuning peg in a state wherein it is reliably clamped to the tuning peg.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1A:
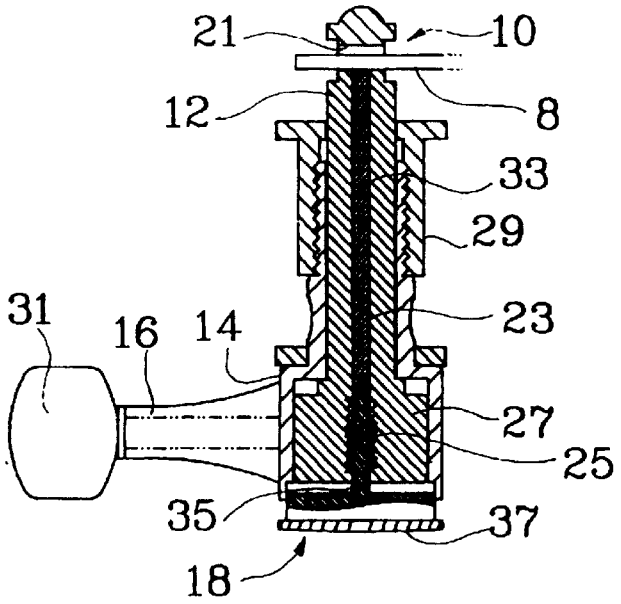
FIG. 1a Prior Art
FIG. 1*a* is a longitudinal cross-sectional view of a conventional guitar string tuning device, illustrating a state wherein a guitar string is inserted through a hole which is defined in a tuning peg.
Figure 1B:
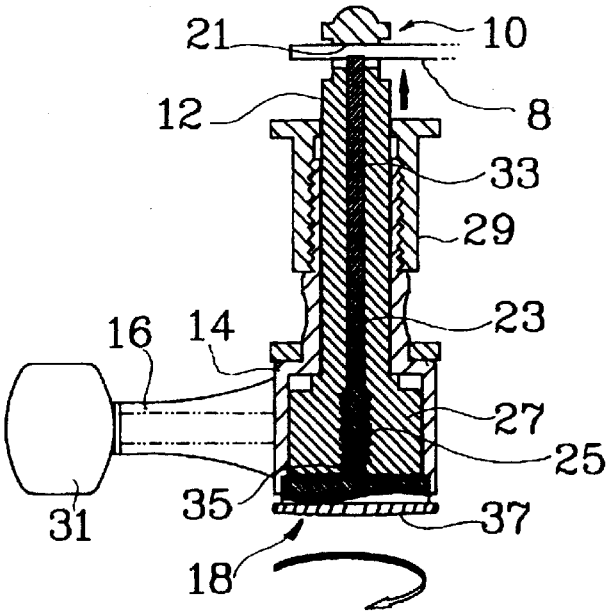
FIG. 1b Prior Art
FIG. 1*b* is a view similar to FIG. 1*a*, illustrating another state wherein the guitar string is clamped to the tuning peg.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
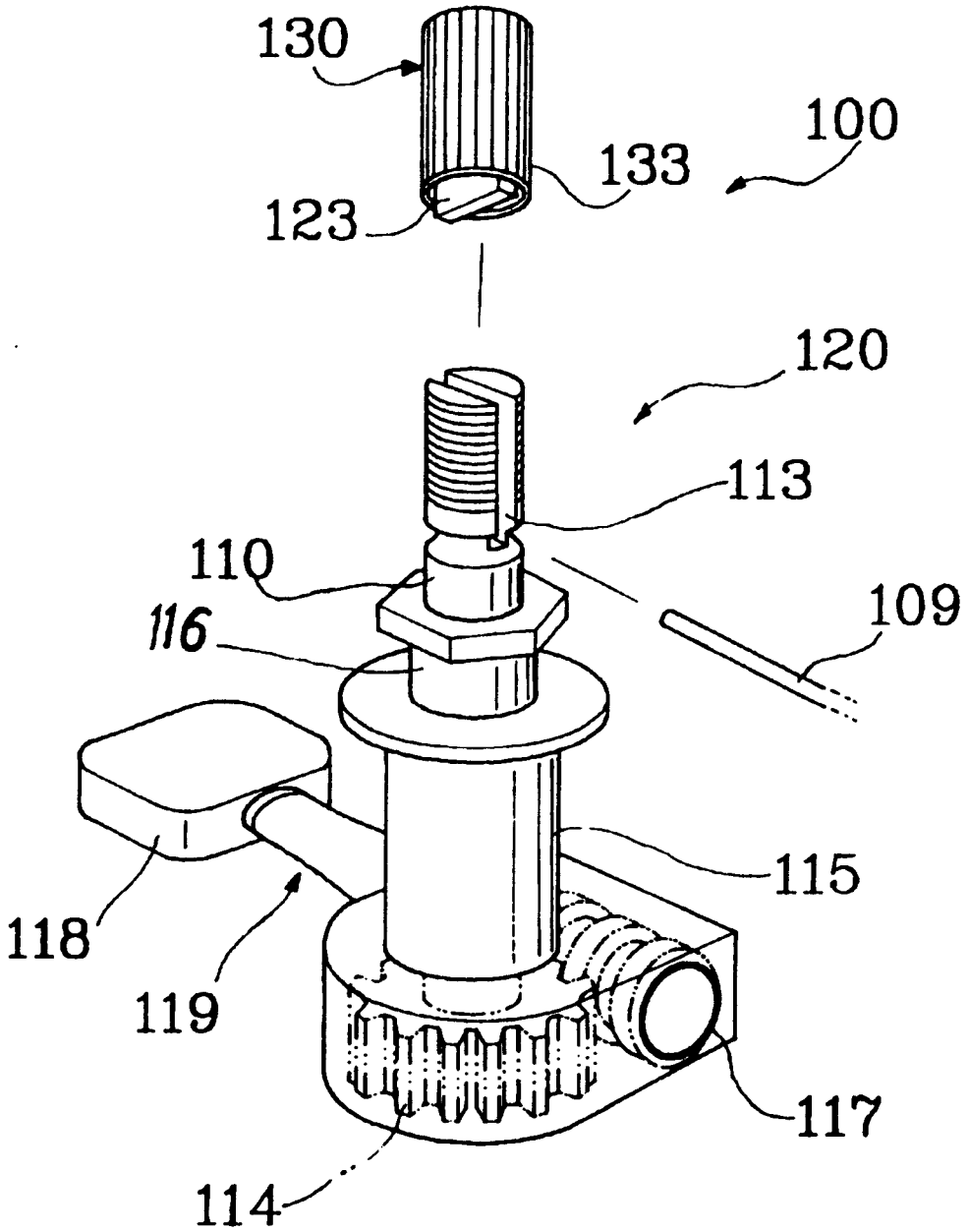
FIG. 2 is a perspective view illustrating a guitar string tuning device in accordance with an embodiment of the present invention.

Referring to FIG. 2, there is shown a perspective view illustrating a guitar string tuning device in accordance with an embodiment of the present invention.

The guitar string tuning device 100 according to the present invention includes a tuning peg 110 which is capable of winding therearound and unwinding therefrom a guitar string 109, a housing 115 which accommodates the tuning peg 110 therein in a manner such that the tuning peg 110 is maintained therein in an upright posture, a manipulating lever 119 which is mechanically coupled to the tuning peg 110 which is accommodated in the housing 115, and a clamping section 120 which clamps the guitar string 109 to the tuning peg 110 which is rotated by the manipulating lever 119.

The tuning peg 110 has a slit 113 which is defined at an upper end of the tuning peg 110 such that the slit 113 is opened upward and a worm wheel 114 which is formed at a lower end of the tuning peg 110. The housing 115 extends in a direction where the tuning peg 110 is mounted thereto, and a cap member 116 is fastened to an upper end of the housing 115 to effectively support the tuning peg 110. A chamber (not numbered) is defined at a lower end of the housing 115 which lower end corresponds to a place where the worm wheel 114 of the tuning peg 110 is located. A worm 117 is formed at one end of the manipulating lever 119 in a manner such that the worm 117 enters into the chamber which is defined at the lower end of the housing 115 to be meshed with the worm wheel 114 of the tuning peg 110. A tuning handle 118 is formed at the other end of the manipulating lever 119 in such a manner that the worm 117 can be smoothly rotated by manipulating the tuning handle 118.

The clamping section 120 includes a clamping shaft 123 which has a predetermined width extending in a lengthwise direction of the guitar string 109 which is inserted through the slit 113 defined in the tuning peg 110, and threadedly movable means 130 which allows the clamping shaft 123 to be moved in a direction wherein the clamping shaft 123 squeezes the guitar string 109 against a bottom surface of the slit 113 defined in the tuning peg 110.

While it is possible for the clamping shaft 123 to squeeze upward the guitar string 109, in this preferred embodiment of the present invention, the slit 113 is opened upward and the clamping shaft 123 is fitted downward into the slit 113 to squeeze downward the guitar string 109 against the bottom surface of the slit 113, from the standpoint of structural simplicity and user convenience.

Furthermore, a lower end of the clamping shaft 123 which is brought into contact with the guitar string 109, can be formed to have a flat surface or to have a curvature corresponding to that of the guitar string 109. By this, the clamping shaft 123 can be brought, not into point contact, but into line or surface contact with the guitar string 109.

The threadedly movable means 130 of the clamping section 120 includes an externally threaded portion which is formed on a circumferential outer surface at the upper end of the tuning peg 110 in such a manner that the externally threaded portion extends by a predetermined distance which substantially corresponds to a depth of the slit 113, and an internally threaded locking sleeve 133 which is threadedly locked to the externally threaded portion.

The clamping shaft 123 is mounted in and to the internally threaded locking sleeve 133 by means of a rivet, a screw, etc. in such a manner that the clamping shaft 123 can be fitted into the slit 113 which is defined in the tuning peg 110.

Consequently, as the internally threaded locking sleeve 133 is threadedly moved downward in a state wherein it is threadedly locked to the externally threaded portion which is formed at the upper end of the tuning peg 110, the clamping shaft 123 squeezes the guitar string 109 against a bottom wall of the slit 113 which is defined at the upper end of the tuning peg 110, thereby clamping the guitar string 109 to the tuning peg 110.

Figure 3A:
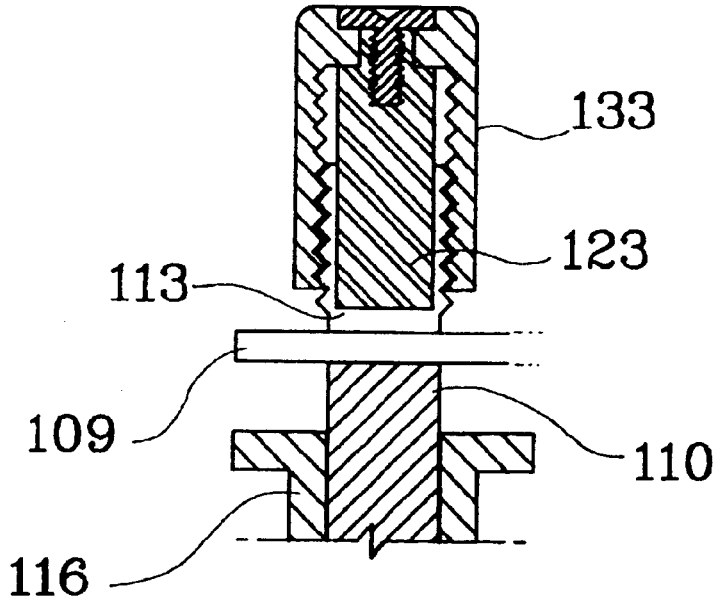
FIG. 3*a* is a partial longitudinal cross-sectional view of the guitar string tuning device of FIG. 2, illustrating a state wherein a guitar string is inserted through a slit which is defined in a tuning peg.
Figure 3B:
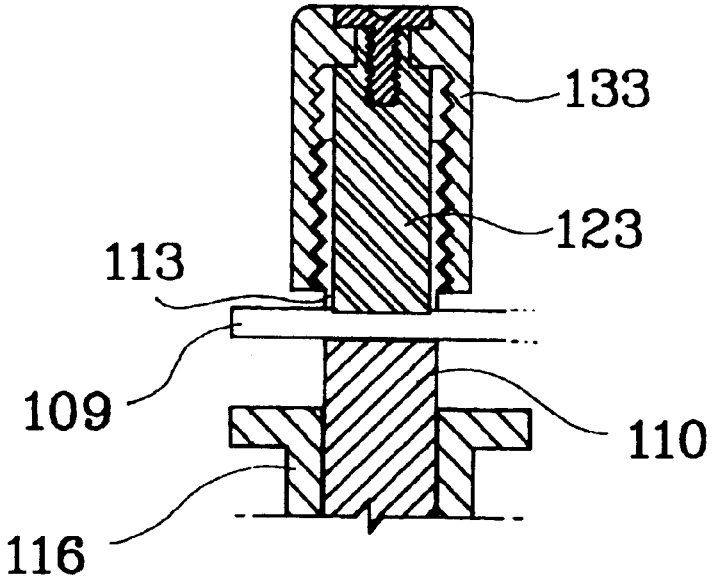
FIG. 3*b* is a view similar to FIG. 3*a*, illustrating another state wherein the guitar string is clamped to the tuning peg.

FIG. 3*a* is a partial longitudinal cross-sectional view of the guitar string tuning device of FIG. 2, illustrating a state wherein a guitar string is inserted through a slit which is defined in a tuning peg; and FIG. 3*b* is a view similar to FIG. 3*a*, illustrating another state wherein the guitar string is clamped to the tuning peg.

Referring to FIG. 3*a*, after the guitar string 109 is inserted through the slit 113 which is defined at the upper end of the tuning peg 110, by rotating the internally threaded locking sleeve 133 to threadedly move it downward in a state wherein it is threadedly locked to the externally threaded portion of the tuning peg 110, as the clamping shaft 123 is fitted into the slit 113 from the opened upper end of the slit 113, the guitar string 109 is squeezed against the bottom wall of the slit 113 by the clamping shaft 12 thereby to be clamped.

As shown in FIG. 3*b*, the clamping shaft 123 squeezes downward a predetermined length of the guitar string 109 in a direction perpendicular to a lengthwise direction of the guitar string 109. At this time, the predetermined length of the guitar string 109 corresponds to a width of the clamping shaft 123 which in turn corresponds to a width of the slit 113 which is defined in the tuning peg 110.

As described above, the guitar string tuning device according to the present invention provides advantages in that, since uniform clamping force is exerted over a predetermined length of a guitar string in a direction perpendicular to a lengthwise direction of the guitar string when clamping the guitar string after inserting it through a slit defined in a tuning peg, it is possible to prevent the guitar string from easily snapping due to stress concentration.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A guitar string tuning device comprising:

a tuning peg for winding therearound and unwinding therefrom a guitar string thereby to tune the guitar string, the tuning peg having a slit which is defined at an upper end thereof and a worm wheel which is formed at a lower end thereof;

a housing for accommodating the tuning peg therein in a manner such that the tuning peg is maintained in an upright posture;

a manipulating lever having a worm which is formed at one end thereof in a manner such that the worm enters into the housing to be meshed with the worm wheel of the tuning peg which is accommodated in the housing and a tuning handle which is formed at the other end thereof; and a clamping section for clamping the guitar string to the tuning peg which is rotated by manipulating the tuning handle, the clamping section including a clamping shaft which has a predetermined width extending in a lengthwise direction of the guitar string which is inserted through the slit of the tuning peg, the clamping section further including threadedly movable means for allowing the clamping shaft to be moved in a direction wherein the clamping shaft squeezes the guitar string against a bottom surface of the slit defined in the tuning peg.

2. The guitar string tuning device as claimed in claim 1, wherein the threadedly movable means of the clamping section comprises:

an externally threaded portion formed on a circumferential outer surface at the upper end of the tuning peg in such a manner that the externally threaded portion extends by a predetermined distance which substantially corresponds to a depth of the slit; and an internally threaded locking sleeve threadedly locked to the externally threaded portion, the clamping shaft being mounted in and to the internally threaded locking sleeve in such a manner that the clamping shaft can be fitted into the slit defined in the tuning peg.

* * * * *